US006065727A

United States Patent [19]

Fitzgerald et al.

[11] Patent Number: 6,065,727

[45] Date of Patent: May 23, 2000

[54] HOLSTER FOR A BED MONITOR ELECTRONIC CONTROL MODULE

[75] Inventors: Sanford G. Fitzgerald; Patrick W. Lovely, both of Tulsa, Okla.

[73] Assignee: Bed-Check Corporation, Tulsa, Okla.

[21] Appl. No.: 09/205,050

[22] Filed: Dec. 3, 1998

[51] Int. Cl.[7] ..... A47H 1/16

[52] U.S. Cl. ..... 248/302; 248/309.1

[58] Field of Search ..... 248/309.1, 311.2, 248/314, 302, 303, 175, 95, 97; D6/567

[56] References Cited

U.S. PATENT DOCUMENTS

| | | | |
|---|---|---|---|
| D. 361,462 | 8/1995 | Newham | D6/567 |
| 1,584,857 | 5/1926 | Hobbs | 248/311.2 |
| 4,267,997 | 5/1981 | Meier | 248/97 |
| 4,324,381 | 4/1982 | Morris | 248/311.2 |

*Primary Examiner*—Ramon O. Ramirez

*Attorney, Agent, or Firm*—Frank J. Catalano

[57] ABSTRACT

A holster for a bed monitor electric control module consists of two substantially rigid continuous wire loops bent into identical inverted-Ls of height less than a height of the module and held in back-to-back spaced apart relationship by upper and lower substantially rigid parallel wire cross members fixed to rearward vertical portions of the inverted-Ls. The cross members are of length and the upper horizontal portions of the inverted-Ls are of contour so as to constrain horizontal movement of a module which is inserted downwardly therein and seated on the lower horizontal portions of the inverted-Ls. A hanger is formed from a resiliently flexible wire bent into a configuration compatible with the holster and which can be flexed to permit insertion cf the hanger into the holster, manipulation of the hanger within the holster and release of the hanger into interlocking relationship with the holster so as to constrain movement of the holster relative to the hanger. To disengage the hanger from the holster, the hanger is again flexed, manipulated and withdrawn from the holster.

3 Claims, 3 Drawing Sheets

F
69
50
F
61
65
63
55
67
33
51
57
53
25
35
21
15
10
27
11
17
23
29
13
31

HOLSTER FOR A BED MONITOR ELECTRONIC CONTROL MODULE

BACKGROUND OF THE INVENTION

This invention relates generally to holsters for bed monitor electronic control modules and the like and more particularly concerns holsters mountable to a variety of supporting structures.

Control module holsters are typically plastic receptacles having a rear wall which is abutted against and secured to the building wall or adapted in a three piece assembly for mounting on a bed or chair or other structure to be monitored. The components are comparatively expensive and fragile and the solid plastic walls tend to smother the alarm speakers.

It is, therefore, an object of this invention to provide a holster for a bed monitor electric control module. A further object of this invention is to provide a holster for a bed monitor electronic control module which does not have solid walls. Yet another object of this invention is to provide a holster for a bed monitor electronic control module which spaces the holster from its supporting structure. It is also an object of this invention to provide a holster for a bed monitor electronic control module which is easily convertible from a wall mounting to a bed mounting device. Another object of this invention is to provide a holster for a bed monitor electronic control module which is converted from a wall mounting to a bed mounting device by use of a single piece hanger. A further object of this invention is to provide a holster for a bed monitor electronic control module which is inexpensive in comparison to its plastic predecessors.

SUMMARY OF THE INVENTION:

In accordance with the invention, a holster for a bed monitor electric control module has first and second substantially rigid continuous wire loops bent into identical inverted-Ls of height less than a height of the module and arranged in back-to-back spaced apart relationship. Upper and lower substantially rigid parallel wire cross members are fixed to rearward vertical portions of the inverted-Ls. The cross members are of length and the upper horizontal portions of the inverted-Ls are of contour so as to constrain horizontal movement of a module inserted downwardly therein with the module seated on the lower horizontal portions of the inverted-Ls. In one embodiment, upper and lower loop clamps are engaged on the upper and lower cross members for fastening the holster to a wall or other vertical planar surface.

In a specially preferred embodiment, a hanger is formed from a resiliently flexible wire having end portions thereof bent into spaced-apart hooks with vertical shanks. The hooks extend rearwardly and upwardly from lower ends of the shanks. The shanks also have upper ends bent to extend rearwardly and then outwardly. The length of the shanks is substantially equal to a distance from a bottom of the lower cross member to a top of the upper cross member and the distance between outer ends of the outwardly extending portions of the shank upper ends is greater than the length of the cross members. The portion of the wire between the outwardly extending portions of the shanks is bent to engage on and be supported by a bed frame or other structure with the hooks depending downwardly therefrom. Thus, the hanger can be flexed to reduce the space between the shanks. The hooks of the compressed hanger are then engaged under and against the lower cross member. Once so engage the rearwardly extending shank portions are engaged over and against the upper cross member. This locks the holster to the hanger to constrain relative vertical motion. The hanger is then released to expand to its original shape. The sides of the rearwardly extending shank portion engage against the inside of the rearward vertical portions of the inverted-Ls to constrain relative lateral motion. Finally, the shanks engage against the front of the cross members and the outwardly extending shank portions engage against the sides of the rearward vertical portions of the inverted-Ls to constrain relative forward and rearward motion. The holder and hanger are thus interlocked into an integral unit.

To disengage the hanger from the holster, the hanger is again compressed to reduce the distance between the shanks and the above engaging process is reversed.

BRIEF DESCRIPTION OF THE DRAWINGS

Other objects and advantages of the invention will become apparent upon reading the following details description and upon reference to the drawings in which.

Figure 1:
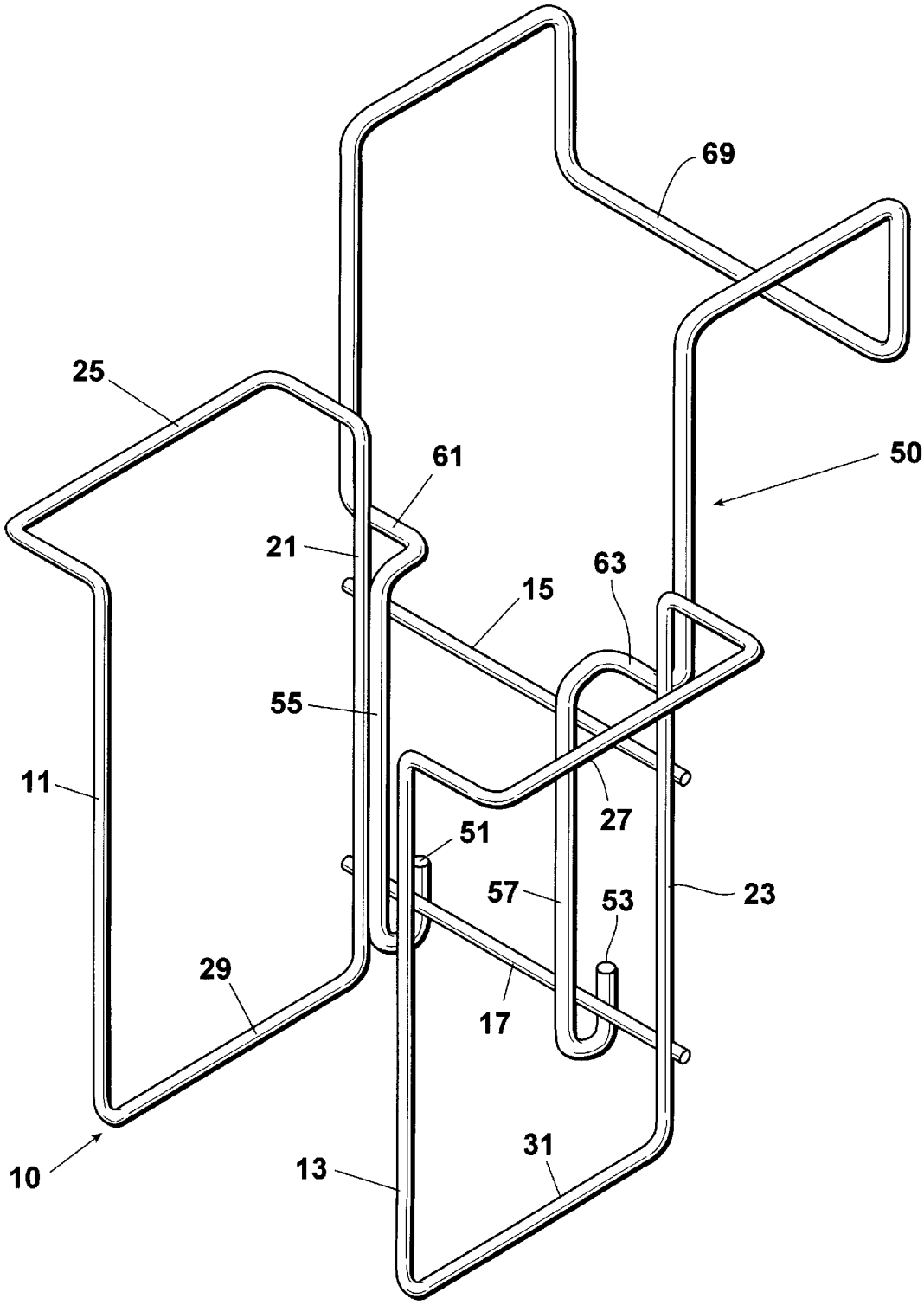
FIG. 1 is a perspective assembly view taken from the right upper front of the preferred embodiment of the holster and hanger of the present invention interlocked into an integral unit.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Turning to the Figures, a preferred embodiment of the invention includes an interlocking holster 10 and hanger 50. The holster 10 is preferably made of nine gauge steel wire finished with a black powder coating. Nine gauge steel wire has been found suitable to assure that a holster approximately 3½ inches wide by 3½ inches high by 2½ inches deep will be substantially rigid. By substantially rigid, it is meant that the holster 10 will not flex or distort as a result of the application of normal forces incurred in the mounting and use of the holster. The hanger 50 is made of eleven gauge tempered steel wire finished with a black powder coating. Eleven gauge tempered steel wire has been found suitable to allow sufficient resilient flexure in a hanger adapted for use with a holster of the above approximate size as to permit easy interlocking and disengagement of the hanger to and from the holster and yet be sufficiently resistant to flexure as to maintain the interlocked relationship of the hanger to the holster.

As shown, the holster 10 includes two substantially rigid continuous wire loops 11 and 13 bent to form identical L-shaped members. The members 11 and 13 are held in inverted, spaced apart, back-to-back relationship by upper and lower cross members 15 and 17 which are welded at their ends to the rearward vertical portions 21 and 23 of the L-shaped members 11 and 13. The height of the L-shaped members 11 and 13 is less than the height of the module (not shown) which is to be held by the holster 10. The length of the parallel cross members 15 and 17 is such that the upper horizontal portions of the inverted L members 11 and 13 will constrain horizontal movement of the module (not shown) when it is inserted downwardly into the opening formed by the upper horizontal portions 25 and 27 and is seated on the lower horizontal portions 29 and 31 of the inverted L members 11 and 13. Preferably, the upper horizontal portions 25 and 27 of the members 11 and 13 are contoured to complement the shape of the module (not shown) and therefore assist in constraining the module (not shown) against horizontal movement.

The hanger 50 consists of a resiliently flexible wire which has its end portions bent to form two spaced apart hooks 51 and 53 with vertical shanks 55 and 57. The hooks 51 and 53 extend rearwardly and upwardly at the lower ends of the shanks 55 and 57 and the shanks 55 and 57 have upper ends 61 and 63 which are bent to extend rearwardly and then outwardly from the shanks 55 and 57. The length of the shanks 55 and 57 is substantially equal to the distance from the bottom of the lower cross member 17 to the top of the upper cross member 15 on the holster 10. The distance between the outer ends 65 and 67 of the upper extending portions 61 and 63 of the shanks 55 and 57 is greater than the length of the cross members 15 and 17. The portion 69 of the wire between the upper extending portions of the shanks 55 and 57 is bent to engage on and be supported by a bed, chair or other structure with the shanks 55 and 57 depending downwardly.

Figure 2:
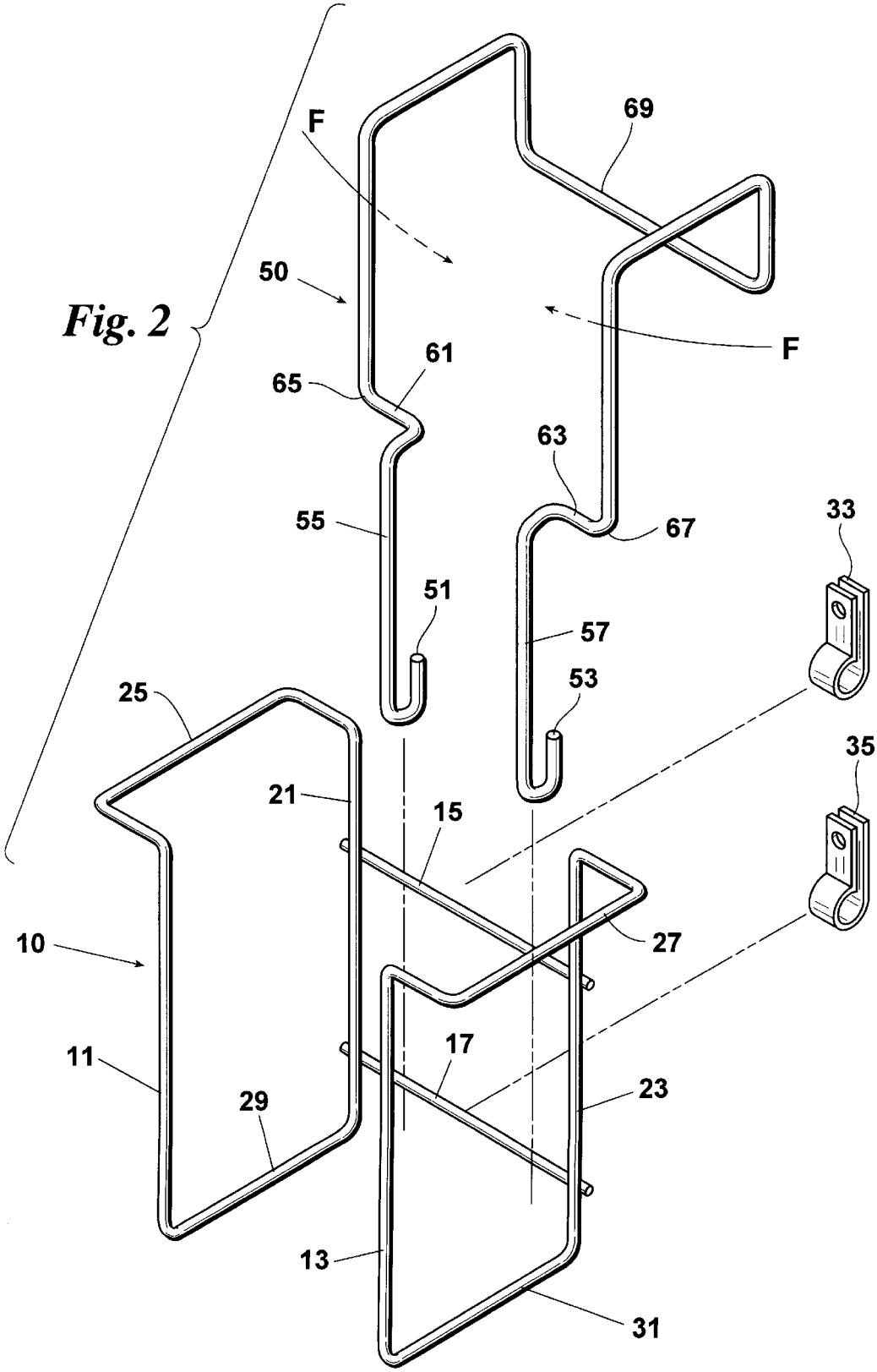
FIG. 2 is a perspective assembly view taken from the right upper front of the holster and hanger of FIG. 1.

As can best be seen in FIG. 2, to interlock the holster 10 and hanger 50, force F is applied horizontally to reduce the distance between the hooks 51 and 53 and the upper extending portions of the shanks 55 and 57. The hanger 50 is then inserted downwardly into the holster 10 and the hooks 51 and 53 are engaged under and against the lower cross member 17 of the holster 10. The rearwardly depending portions of the upper portions 61 and 63 of the shanks 55 and 57 are then slid over and against the upper side of the upper cross member 15. In this compressed condition, the outer ends 65 and 67 of the upper extending portions of the shanks 55 and 57 will pass between the rearward vertical members 21 and 23 of the holster 10. When the force F on the hanger is released, the hanger resiliently returns to its unbiased condition. In this condition, the hooks 51 and 53 and rearwardly extending portions of the upper extending portions 61 and 63 of the shanks 55 and 57 engage with the cross members 15 and 17 to constrain relative vertical movement of the hanger 50 with respect to the holster 10. The rearwardly extending portions of the upper extending portions 61 and 63 of the shanks 55 and 57 also engage against the inside edges of the rearward vertical members 21 and 23 of the holster 10 to constrain lateral movement of the hanger 50 in relation to the holster 10. Finally, the shanks 55 and 57 engage against the front of the cross members 15 and 17 while the outwardly upper extending portions of the upper extending portions 61 and 63 of the shanks 55 and 57 engage against the rear of the rearward vertical portions 21 and 23 of the holster 10 to constrain forward and rearward motion of the hanger 50 in relation to the holster 10.

If the holster 10 is to be mounted on a wall or other planar vertical surface, loop clamps 33 and 35, as can best be seen in FIG. 2, can be engaged on the cross members 15 and 17 and then fastened to the wall or other structure.

Figure 3:
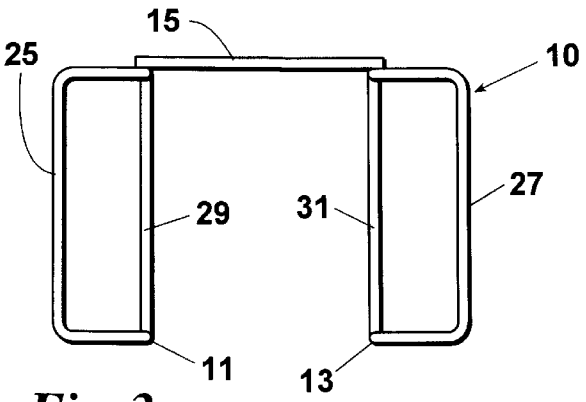
FIG. 3 is a top plan view of the holster of FIG. 1.
Figure 4:
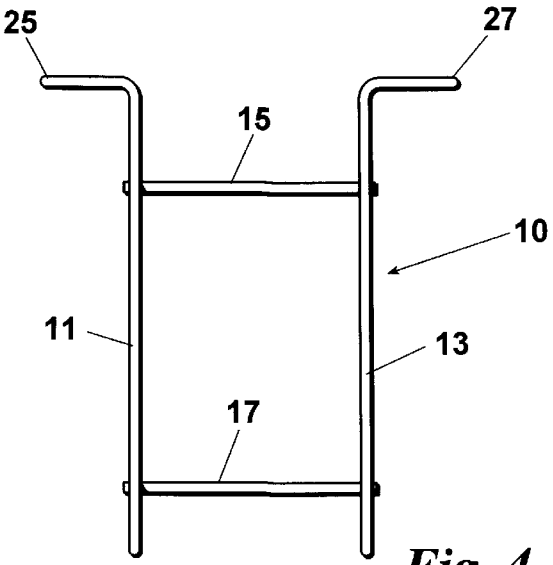
FIG. 4 is a front elevation view of the holster of FIG. 1.
Figure 5:
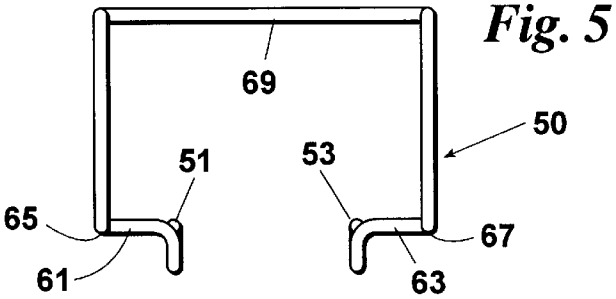
FIG. 5 is a top plan view of the hanger of FIG. 1.
Figure 6:
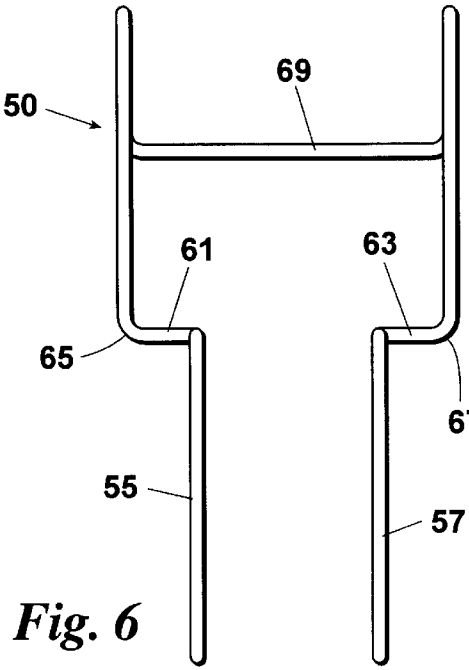
FIG. 6 is a front elevation view of the hanger of FIG. 1.
Figure 7:
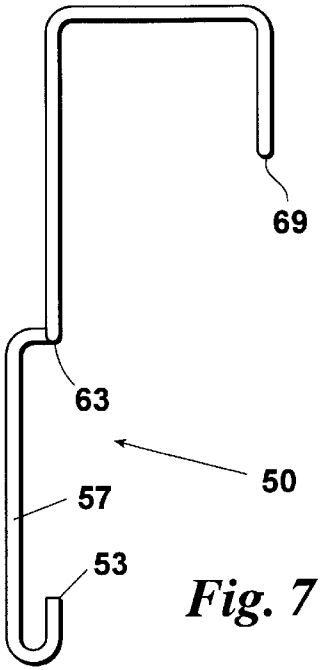
FIG. 7 is a right side elevation view of the hanger of FIG. 1.

Preferably, as can best be seen in FIG. 3, the cross members 15 and 17 will be bent to form a bow which assures that the monitor and its speaker (not shown) will not be held in a laminar orientation against the wall or other mounting structure. Thus, neither the holster 10 nor the wall will muffle the sound of the monitor speaker.

Thus, it is apparent that there has been provided, in accordance with the invention, a holster that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A holster for a module comprising:

first and second substantially rigid continuous wire loops bent into identical inverted-Ls of height adapted to be less than a height of the module and arranged in back-to-back spaced apart relationship;

upper and lower substantially rigid parallel wire cross members fixed to rearward vertical portions of said inverted-Ls, said cross members being of length and upper horizontal portions of said inverted-Ls being of contour adapted to constrain horizontal movement of the module when the module is inserted downwardly therebetween and is seated on lower horizontal portions of said inverted-Ls; and means connectable to said holster for hanging said holster from another structure.

2. A holster according to claim 1, said hanging means comprising upper and lower loop clamps engaged on said upper and lower cross members, respectively, and means for fastening said clamps to a vertical planar surface.

3. A holster for a module comprising:

first and second substantially rigid continuous wire loops bent into identical inverted-L's of height less than a height of the module and arranged in back-to-back spaced apart relationship;

upper and lower substantially rigid parallel wire cross members fixed to rearward vertical portions of said inverted-L's, said cross members being of length and upper horizontal portions of said inverted-L's being of contour so as to constrain horizontal movement of the module inserted downwardly therebetween when the module is seated on lower horizontal portions of said inverted-L's; and a resiliently flexible wire having end portions thereof bent into spaced-apart hooks with vertical shanks, said hooks extending rearwardly and upwardly from lower ends of said shanks and said shanks having upper ends bent to extend rearwardly and then outwardly, a length of said shanks being substantially equal to a distance from a bottom of said lower cross member to a top of said upper cross member and a distance between outer ends of said outwardly extending portions of said shank upper ends being greater than a length of said cross members, a portion of said wire between said outwardly extending portions of said shanks being bent to engage on and be supported by another structure with said hooks depending downwardly therefrom, said hooks being engagable with said lower cross-member and said shank upper ends being engagable against said rearward vertical portions of said inverted L's to interlock said first and second wire loops and crossmembers to said resiliently flexible wire.

* * * * *